United States Patent [19]

Whitlock

[11] 4,325,820

[45] Apr. 20, 1982

[54] HIGH TENSION ELECTROSTATIC SEPARATORS

[75] Inventor: David R. Whitlock, Bernardsville, N.J.

[73] Assignee: Advanced Energy Dynamics, Inc., Natick, Mass.

[21] Appl. No.: 119,867

[22] Filed: Feb. 8, 1980

[51] Int. Cl.[3] ..... B03C 7/06

[52] U.S. Cl. ..... 209/127 R; 209/129

[58] Field of Search ..... 209/127–131

[56] References Cited

U.S. PATENT DOCUMENTS

| | | | |
|---|---|---|---|
| 801,380 | 10/1905 | Huff | 209/130 |
| 977,570 | 12/1910 | Sutton | 209/127 R |
| 1,679,739 | 8/1928 | Overstrom | 209/129 |
| 2,187,637 | 1/1940 | Sutton | 209/129 |
| 2,258,367 | 10/1941 | Johnson | 209/127 R |
| 3,013,662 | 12/1961 | Phillips | 209/129 |

FOREIGN PATENT DOCUMENTS

| | | | |
|---|---|---|---|
| 589609 | 12/1933 | Fed. Rep. of Germany | 209/127 R |
| 493248 | 1/1971 | U.S.S.R. | 209/127 R |

OTHER PUBLICATIONS

Mined & Quarry Eng., Jul. 1941, p. 198.

Res. Report No. Bu Mines R17732, "Removal of Pyrite From Coal by Dry Sep. Methods", Abel et al., May 1973, NTIS Release PR-221.

*Primary Examiner*—Robert Halper

*Attorney, Agent, or Firm*—Wolf, Greenfield & Sacks

[57] ABSTRACT

A rotor-type electrostatic separator is described with means to remove a boundary layer of entrained air from the rotating collector surface prior to depositing on the surface a particulate feed for particle separation. Following the feed hopper a new boundary layer of air with particles in it is entrained on the rotating collector surface. Means are also provided to shield from the action of corona wind the region immediately following the feed hopper where the particles enter the newly-forming boundary layer.

16 Claims, 8 Drawing Figures

HIGH TENSION ELECTROSTATIC SEPARATORS

BACKGROUND OF THE INVENTION

This invention relates to improved methods and apparatus for the separation or beneficiation of particulate solid substances by means of an electrification mechanism generally classified under the heading "Electrostatic Separation", and more particularly to the separation or beneficiation of particulate materials containing a significant percentage of fines, i.e.: dust-like material ranging in size down to about 20 microns. The term "electrostatic separation" as used in this specification is intended to have the scope of meaning that is ascribed to it in "Chemical Engineers' Handbook", Robert H. Perry and Cecil H. Chilton, Editorial Directors; 5th Edition 1973, in the article entitled "Electrostatic Separation" at pages 21-62 to 21-65—McGraw-Hill Book Company, New York, New York. However, in the embodiments which are described in this specification, the invention is disclosed in relation to "high tension" separation methods and apparatus, which fall in Perry and Chilton's Group 3—Electrification by Ion Bombardment, described on pages 21-63 and 21-64 of their Handbook. Moreover, the apparatus illustrated in the accompanying drawings and described in the specification is the rotor type, in which particulate matter is delivered to a grounded rotor for separation or beneficiation.

High tension separation is an outgrowth of electrostatic separation, but has many unique properties of its own. The term "electrostatic" implies that no current is flowing. In high tension separation the particulate feed is sprayed with mobile ions, that is, a corona discharge, while the particles are being fed to and presumably come into contact with a grounded electrically conductive surface such as the surface of a rotating metal cylinder. In this way it is intended that all of the particles will be charged by the mobile ions, and that the particles of electrically non-conductive and poorly-conductive materials will lose their charges slowly, will be pinned to the grounded conductive surface by their own image forces, and will be removed from the grounded conductive surface at a location outside the influence of the corona discharge. The particles of electrically-conductive material, on the other hand, lose their charges rapidly to the grounded conductive surface and, upon being removed from the influence of the corona discharge (i.e.: the mobile-ion spray), they become free to assume normal trajectories away from the grounded electrical surface, under gravitational or centrifugal forces.

High tension electrostatic separation methods have worked well with, and have essentially been restricted to dry feeds in the size range of about 20 to about 150 mesh. An example of electrostatic separation as employed in the dry concentration of ion-bearing ores (e.g.: specular hematite) crushed to minus 20 mesh is described in U.S. Pat. No. 3,031,079. Pretreatment to provide discrete surfaces for selective electrification of individual particles has included dedusting and desliming (Perry and Chilton, ibid, at page 21-63). Examples given by the authors (at page 21-65) are: a minus 8-mesh grid would probably need disliming at 200 mesh; a minus 20-mesh grid at 325 mesh; and a minus 35-mesh grid at 400 mesh. As far as is now known to the present inventor, no successful application of electrostatic separation of dust-like materials has heretofore been made.

In the near-desperate attempts now being made to remove from coal sufficient of the sulfur content so that coal can be used as an energy source in place of oil, it has been found that pyrite is the major source of sulfur, and that pyrite can be distributed in various coals on a scale finer than 50 micrometers. It has also been found that coal which is pulverized that fine forms dense black clouds in a high tension separator, coating the electrodes and other parts, and the components of the coal-pyrite mixture cannot be separated. The long-felt want of an electrification mechanism for separating the components of a dust-like mixture of particles, which has been generally apparent in the art, is now seen to be a critical need of the nation's energy resources.

THE PRIOR ART

A prior proposal for the high tension separation of dust-like materials is described in Breakiron et al., U.S. Pat. No. 3,222,275, May 30, 1967, which is assigned to Carpco Research and Engineering, Inc., Jacksonville, Florida. According to the patentees, very fine particles which are of a mesh size of −200 are amenable to high tension separation with a spray of mobile ions produced by a corona discharge pulsed at a rate of between about 150 to about 800 pulses per second. The patentees state (column 1, lines 60-65)—"Attempts by the art to employ high tension separation with materials which necessitate grinding to an extremely fine particle size in order to effect liberation, uniformly have been unsuccessful". The teachings of this patent do not appear to have been successful in altering the stated limitation.

GENERAL NATURE OF THE INVENTION

This invention makes advantageous use of the realization that not all of the particles in a dry particulate feed to the electrically-conductive surface of the grounded rotor, in a high tension separator for example, do actually come into contact with that surface, and that where the feed includes dust-like particle sizes the vast majority of the smaller-sized particles may in fact be prevented from ever reaching the grounded surface. When the particulate feed is dropped onto the electrically conductive surface that is provided for receiving it, the coarser particles are significantly influenced by gravitational forces and can bounce until they assume a charge and become pinned to the conductive surface; the motion of the finer, dust-like particles, on the other hand is controlled by aerodynamic forces, and is only marginally influenced by gravity. Thus, for example, in a gaseous medium, such as air, the motions of the very small particles of both coal and pyrite, many of which have essentially the same effective aerodynamic diameters, are governed essentially by Stokes' Law defining resistance to motion:

$$R=6\pi\eta av$$

Where "$\eta$" is the fluid viscosity, "a" is the radius of the particle (sphere), and "v" is the velocity of the particles. Mass is not relevant at these small particle sizes, with the result that the particles of both coal and pyrite are easily carried or scattered together throughout the ambient gaseous environment. I have discovered that the grounded rotor entrains a layer of air on its surface, and that at the surface of the rotor the air moves at essentially the same velocity as the rotor surface, while at a distance from the rotor surface the air is in the ambient static conditions. This creates a boundary layer of gas (typically air) which rotates with the rotor and is in shear with the ambient gas at some distance from the rotor surface. Dust-like particles cannot penetrate this boundary layer, and so do not reach the grounded rotor surface, and no separation is performed upon them.

In addition, the corona electrodes that are used to spray mobile ions on the particle feed create an intense ion flux. The moving ions entrain air, creating a corona wind. Fine, dust-like particles are easily entrained by this corona wind, which blows them away from the feed-hopper before they can land on the rotor surface.

The present invention addresses these and other aerodynamic considerations involved in electrostatic separation, in contrast to the above-mentioned patent to Breakiron et al, which addresses only electrical parameters of the corona discharge in high tension separation.

To control the effect of the boundary layer, this invention provides a process comprising the following steps: (a) strip the boundary layer off the rotor in a location prior to the feed hopper; (b) introduce the particulate feed onto the rotor surface before the boundary layer has had an opportunity to reform; and (c) allow the boundary layer to reform with the particulate feed entrained in it. In a simple apparatus according to the invention, this process can be realized by incorporating an extension of the feed hopper that is in contact with the rotor surface so as to strip off the boundary layer before the particulate feed is laid down on the rotor surface. In that arrangement when the rotor entrains a boundary layer after passing under the feed hopper the fine particles contained in the feed are incorporated in the newly-formed boundary layer, with the result that when the region is reached where the corona discharge is effective, the fine (dust-like) particles are more easily pinned to the grounded rotor surface.

It is often easier to remove the boundary layer from the rotor surface if it is done some distance prior to the feed hopper, so that the air (or other gas) in the stripped-off boundary layer will be able more easily to escape from the rotor. A mechanical barrier, such as a wiper set against the rotor surface, serves to strip the boundary layer from the rotor. An additional mechanical barrier: e.g., a sheet of flexible or otherwise conforming material extending from the wiper along the rotor surface to the feed hopper, serves to prevent the boundary layer from reforming between the wiper and the feed hopper. "Teflon" (trademark for a film of FEP-Fluorocarbon resin) works well for this purpose because it has a low coefficient of friction, but other flexible sheet materials such as "Mylar" (trademark for a polyester film) are also useful for the same purpose. Once the flexible sheet is established against the rotor surface it is held there by Bernoulli forces, and by the triboelectric charge which develops on a dielectric sheet made of a material such as "Teflon" or "Mylar"; alternatively, the barrier sheet can be maintained in the desired position by mechanical means, or electrostatically by spraying charge onto the outer surface of the sheet. Removing the boundary layer from the rotor in this manner has the added advantage of enclosing the rotor surface in the region immediately prior to the feed hopper, thereby reducing stray wind currents around the apparatus in that region which are caused by the rotating boundary layer in shear with the relatively static ambient air or gas.

In addition to conveying the particles to the grounded rotor surface, where they can be charged by the corona electrode or electrodes, the present invention introduces steps and means to prevent the particles from being blown around by the corona wind. Once the particles are in the boundary layer, the corona wind cannot get at them, but the forces on the mobile ions are great enough so that the ions can penetrate the boundary layer and charge the particles. To prevent the particles from being blown around by the corona wind before the particles can enter the boundary layer, the invention provides means to shield from the action of the corona wind the region immediately following the feed hopper where the boundary layer reforms. An electrically-conductive sheet, suspended over the rotor surface, and in close proximity to it, curved to avoid sharp points that can themselves act as corona generators, can provide an effective shield. In so doing, the corona wind may give rise to a higher pressure region where the particulate feed comes off the hopper, causing fine particles to be blown out of the hopper, or out through leaks in the apparatus following the hopper. The invention further provides to seal the hopper region so that the corona wind cannot, in effect, blow the particulate feed out of the system.

In another method of practicing the invention, the boundary layer is removed from the rotor, and the particulate feed is pneumatically conveyed to the rotor surface in a gas so that the boundary layer reforms from the gas that is used to convey the feed. Apparatus for practicing this method may include a stationary shroud in the form of a conforming sheet covering a part of the rotor surface, and a feed tube entering the shroud for introducing a combined gas/particulate feed onto the enshrouded surface. With this method it may be necessary to guard against escape of the particle/gas mixture from the edges of the rotor or the shroud. This method of feeding particles to the grounded rotor surface has advantages in addition to the boundary layer control. Fine, dust-like particles have a tendency to agglomerate, and high shear forces existing between the rotor surface and the stationary shroud can break up such agglomerates, so that the dust-like particles will be more easily separated. Additionally, this method assures that substantially all the particles in the feed will become entrained in the boundary layer that reforms on the rotor surface under the shroud.

A more detailed description of embodiments of the invention according to the foregoing general description, illustrating a presently-preferred mode of practicing the invention, follows with reference to the accompanying drawings, in which.

Figure 6:
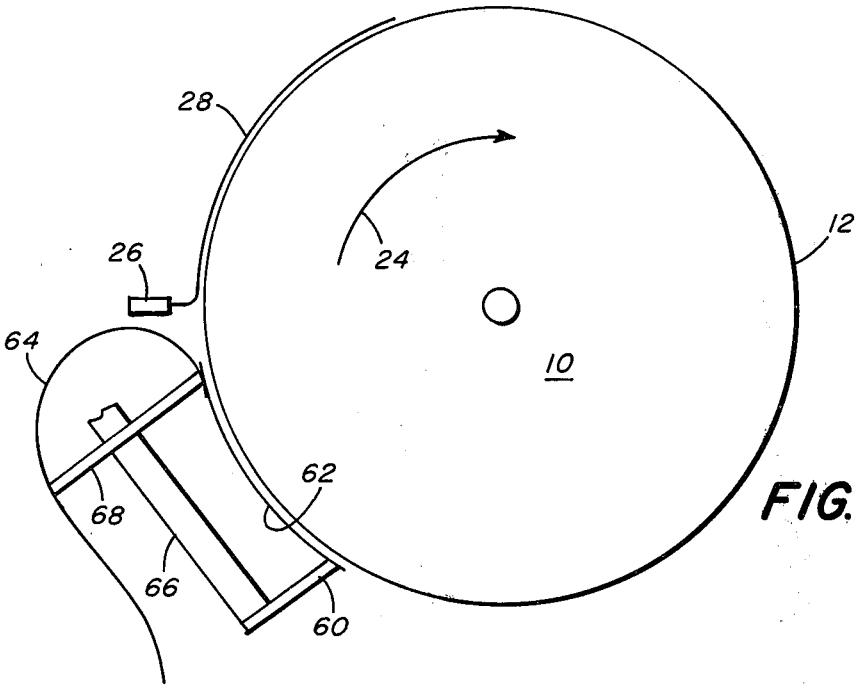
Figure 7:
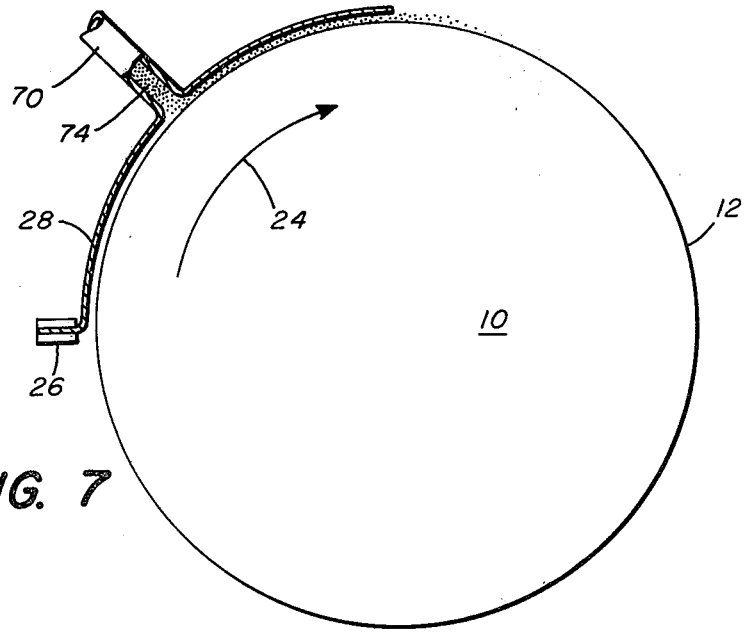
Figure 8:
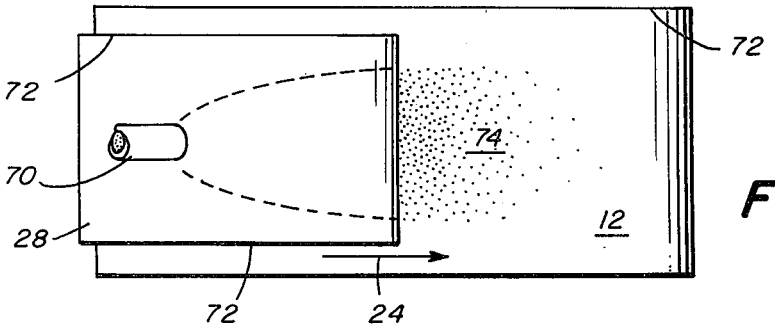

FIG. 6 schematically illustrates an improvement in the doctor device of the particle separator;

FIG. 7 illustrates schematically a combined feed section and boundary layer control section; and FIG. 8 is a plan view of the device shown in FIG. 7.

Figure 1:
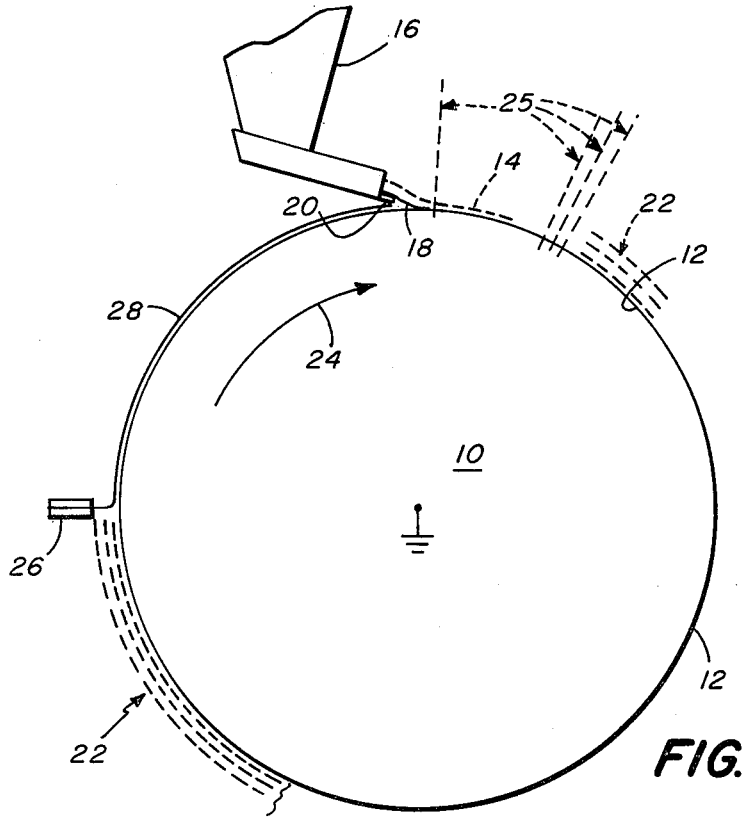
FIG. 1 is a schematic partial side view of a high tension particle separator incorporating an improved feed section of the invention.

In FIg. 1 an electrically-conductive grounded rotor 10 has a cylindrical collecting surface 12 for receiving dry particulate feed 14 from a feed hopper 16. The rotor 10 and hopper 16 are parts of an electrostatic separation apparatus which is generally similar to the electrostatic separator apparatus shown in U.S. Pat. No. 2,548,771 to Carpenter. The above-referenced U.S. Pat. Nos. 3,031,079 and 3,222,275 show later developments of like apparatus. The drawings accompanying this application show primarily those parts of the apparatus to which the invention improves; to simplify the illustrations, parts which are not changed from the prior art, and are not essential to an explanation of the invention, have been omitted. Thus, according to the invention, a sheet 18 of metal (e.g.: brass) is fixed to the lower lip 20 of the feed hopper, and extends into contact with the surface 12. During rotation of the rotor 10, clockwise in FIG. 1 as is indicated by an arrow 24, the surface 12 entrains a boundary layer 22 of the ambient gas (e.g.: air) which is represented in part at the lower left-hand quadrant of the rotor. In the absence of parts 26 and 28, to be described below, this boundary layer of gas would pass up to and under the lip 20. The extending sheet 18 blocks the boundary layer 22 from passing to the feed region 25 of the surface 12 onto which the particulate feed 14 is deposited. This is a simple form of boundary layer stripping. Immediately following the feed region 25 (the down-stream boundary of which is not precisely established, as is indicated in the drawing) the boundary layer 22 reforms from ambient gas, but now the feed particles, including an increased proportion of dust-like fine particles, are entrained in the reformed boundary layer. When now mobile-ion charge is sprayed on the surface 12 (e.g.: from a charging electrode 30 as shown in FIG. 2) the fine particles are more easily pinned to the collecting surface.

The gas in the boundary layer 22 which is blocked by the extending sheet 18 has to escape from the surface 12. The extending sheet 18 compresses that gas and forces it out laterally from under the hopper 16, and that gas can give rise to wind currents which are undesirable in the vicinity of the feed region 14. The air in the boundary layer can escape more easily from the surface 12 if it is stripped away a greater distance from the hopper 16, and for that purpose parts 26 and 28 are preferably added to the apparatus. Part 28 is desirably a flexible or otherwise conforming sheet of dielectric material which is held adjacent the surface 12 by a support 26 which grips the leading edge of the sheet. The sheet 28 is a mechanical barrier which removes the boundary layer 22 at a region far (e.g.: about 90 rotational degrees) in advance of the hopper, and prevents reformation of the boundary layer between the support 26 and the hopper 16. A larger distance is thus provided in which gas removed from the surface 12 can escape from the apparatus, without giving rise to a wind near the hopper. Any material having a low coefficient of friction will work well for this purpose.

Once the sheet 28 is in position against the surface 12 it is held there by Bernoulli forces and by the triboelectric charge that a dielectric material develops sliding over the moving surface 12. Alternatively, the sheet 28 can be held in this position mechanically (by means not shown), or by spraying mobile ion charges onto its outer surface (e.g.: with a charging electrode like the electrode 30 shown in FIG. 2).

Figure 2:
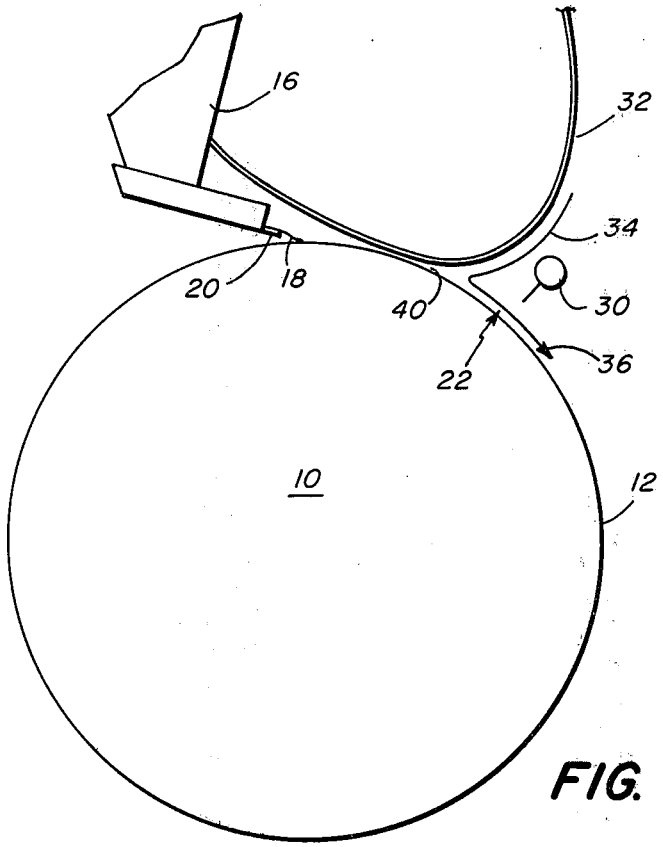
FIG. 2 is a schematic partial side view of the separator of FIG. 1 incorporating a boundary layer control improvement according to the invention.

FIG. 2 illustrates the general concept of a corona shield 32, made of an electrically-conductive material, such as a flexible sheet of brass, to prevent fine particles from being blown around the hopper by corona wind. The corona electrode 30 which is used to spray mobile ions on the drum of a high tension separator (as in the above referenced patents to Carpenter and Breakiron et al, for example) creates an intense ion flux. The moving ions entrain air (or other ambient gas), so that there is a corona wind associated with the use of these corona electrodes. Fine particles have relatively long settling times in air (see discussion of Stokes' Law above), and are therefore highly susceptible of being entrained by this corona wind. It is necessary to deliver all the particles in the dry particle feed to the collector surface 12, where they can be charged by the mobile ions; it is also necessary to prevent them from being blown away by the corona wind on their way to the collector surface, and this is particularly, if not critically true of the smaller-sized particles such as dust-like components of the feed. Once the particles are incorporated in the boundary layer 22 which reforms in or following the feed region 14 the corona wind can no longer get to them, even though the propulsion forces on the mobile ions are great enough so that these ions can penetrate the boundary layer and charge the particles that are entrained within it. However, the fine particles linger and the corona wind can get to them before they can settle into the reformed boundary layer 22. The corona shield 32 shields the region where the boundary layer 22 reforms from the action of the corona wind. This shield prevents the corona wind from blowing the finer, smaller-sized, particles around, and eventually away from the apparatus into the ambient region, where heretofore the dust-like component of particle feeds ground to finer sizes has formed clouds of dust.

The shield 32 works well to prevent cloud formation from the dust-like component of the feed 14, and to retain the smaller-size components in the apparatus for separation as intended, if the shield is electrically conductive, and if the shield itself does not build up a static charge. The shield is preferably curved, as is illustrated in FIG. 2, and it has no sharp points which can act as further corona generators, which might give rise to corona winds of their own. In Research Report No. BuMines RI 7732 entitled "Removal of Pyrite from Coal by Dry Separation Methods", Authors W. T. Abel et al, dated May 1973, NTIS release PB-221, 627, FIG. 3 on page 8 shows a shield which is not curved. The report does not describe or explain the purpose of that shield.

The presence of a corona wind, and the formation of a boundary layer of gas following deposition of the feed 14 on the separator surface 12, may be demonstrated as follows. Using a smoke generator ($NH_4OH+HCl$, for example), to expose the air flow around the rotor 10 when it is turning, operate the apparatus and inject smoke into the region between the corona shield 32 and the corona electrode 30. In the presence of the shield, corona wind (i.e.: air with charged ions in it) is drawn under the shield and then down along the seperator surface 12. This is illustrated by an arrow 34 shaped to follow the path of the smoke. There appears to be a boundary layer approximately one-eighth inch thick on the separator surface 12. At the same time, the shield 32 prevents the corona wind from penetrating the space 40 between the shield 32 and the rotor surface 12.

Figure 5:
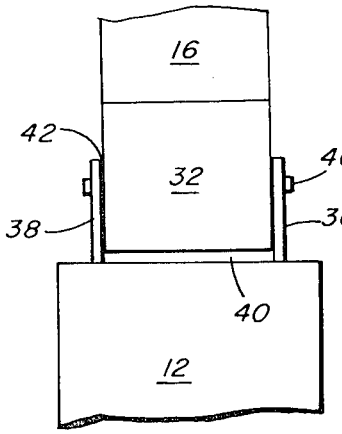
FIG. 5 is a partial section on line 5—5 of FIG. 4.

Although the corona wind itself does not enter the space between the hopper 16 and the feed region 14, the corona wind, being slowed and stopped by the corona shield 32 and the separator surface 12, produces a stagnation pressure, and in so doing it generates a region of increased gas pressure where the fine particles come out of the hopper. This increased pressure can blow the fine particles out of the hopper, or out of any gas leaks in the apparatus following the hopper, before the fine particles have had a chance to settle into the reforming boundary layer 22. It is, therefore, advantageous to seal the feed system including the mouth of the hopper against leaks through which the pressure generated by the corona wind might blow dust-like particles out of the system. One manner of providing the desired seals is illustrated in FIGS. 4 and 5.

Figure 4:
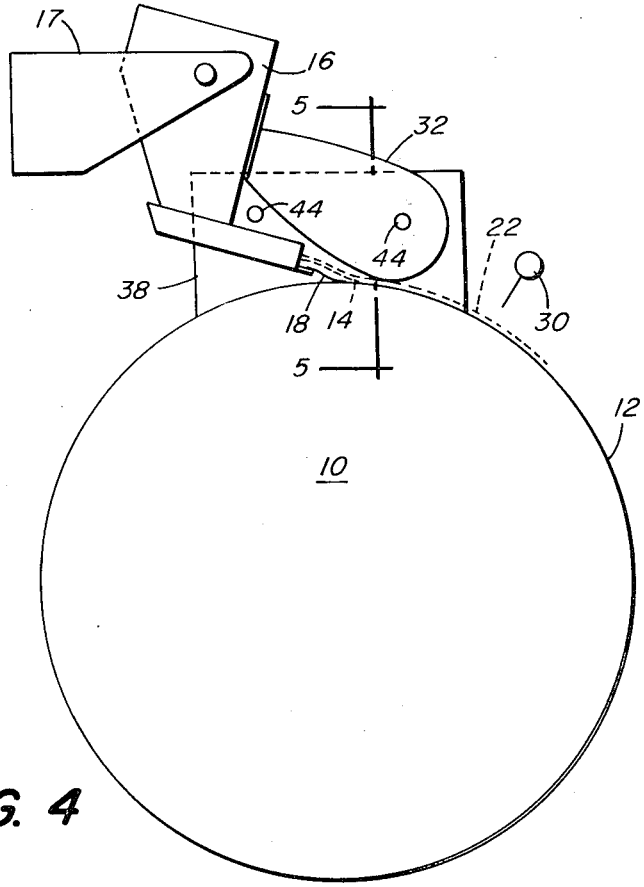
FIG. 4 illustrates the structural features of a practical feed section according to the invention.

In FIG. 4 the hopper 16 is shown mounted on a support 17 which permits adjusting the position of the hopper relative to the rotor surface 12, so that the extension 18 can be placed close enough to the rotor surface to block the flow of boundary layer gas under the particulate feed 14 as the latter is being laid down on the rotor surface. Side plates 36 and 38, shown in FIG. 5, seal the sides of the gap 40 between the corona shield 32 and the rotor surface, as well as the sides of upstream spaces between the hopper 16 and the rotor 10. Gaskets 42 are provided between the side plates and the edge surfaces of the portions of the rotor, corona shield, and hopper which confront the side plates. The side plates may be held in position by any suitable support means. Bolts 46 through holes such as the holes 44 shown in one plate 36, spanning both side plates as shown in FIG. 5, will do. The side plates are useful primarily on separator apparatus having short rotors; as the axial length of the rotor 10 is increased (e.g.: to a length of ten feet) the side plates become less important, The side plates 26 and 38 are electrically connected to the corona wind shield 32, and they are sealed to the hopper 16 by the gaskets 42 so that gas under the back-pressure that may be encountered will not pass out through the sides of the spaces between the hopper and the rotor.

The smallest gap 40 between the corona wind shield 32 and the rotor surface 12 should be about one-eighth inch, so that there will be a high rate of shear in gas located between the stationary shield 32 and the moving surface 12 of the rotor 10. Providing shear in the gas in the gap 40 aids in breaking up agglomerates of particles that might form in the particle feed 14. In addition, a small space between the corona wind shield 32 and the rotor surface 12 restricts air flow under the wind shield. If the minimum spacing in the gap 40 is less than the thickness of the boundary layer 22, there will be no net transport of gas counter to the direction of rotation (arrow 24) of the rotor 10, and this also aids in preventing the corona wind from blowing particles out of the hopper 16. As can be seen in FIG. 4, the corona wind shield 32 is mounted to a wall of the hopper 16, and the size of the gap 40 can be adjusted by tilting the hopper when the position of the hopper is set relative to the rotor 10.

Figure 3:
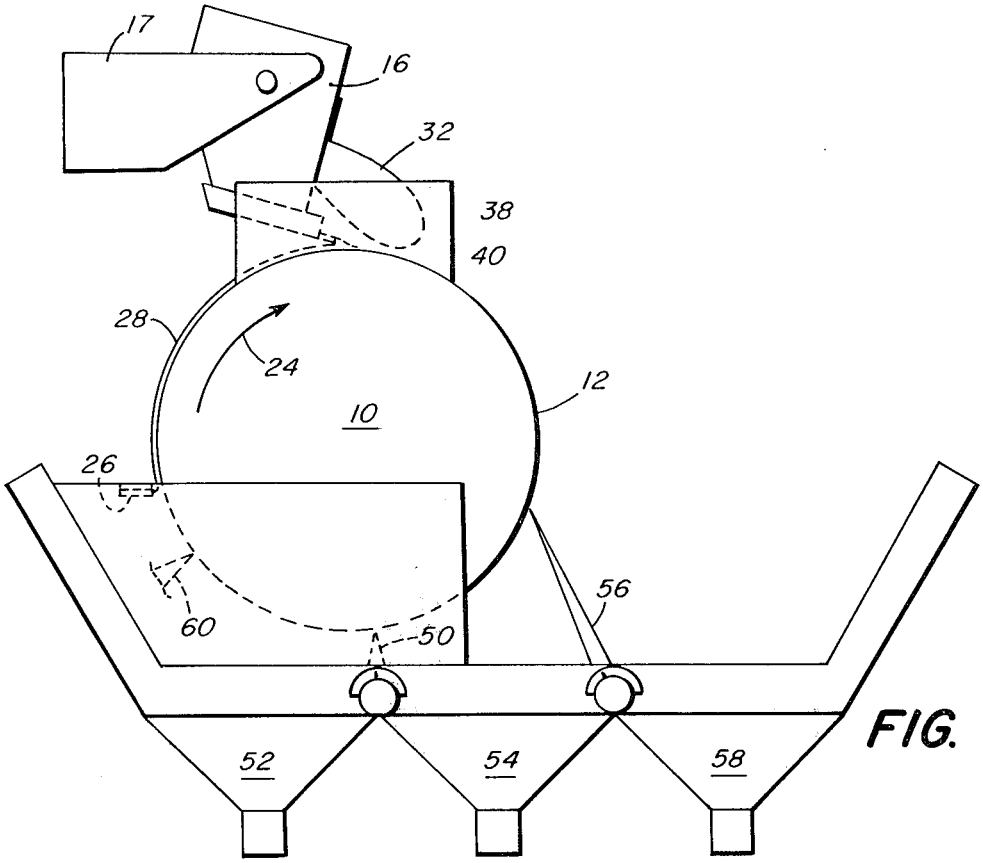
FIG. 3 is a schematic side view of my improved high tension separator with a particle separation section which incorporates a further improvement.

In a complete separator apparatus, as is illustrated in FIG. 3, the rotor 10 is located above a splitter or divider 50 which marks the boundary between a first compartment 52 for receiving a first component of the particulate feed which remains pinned to the surface 12 a longer time than other components (e.g.: coal in a coal/pyrite particle mix), and a middlings compartment 54. Nearer to the feed zone 25 is a second divider 56 marking the boundary between a third compartment 58 for receiving a second component of the particle mix which more readily leaves the rotor surface 12 and the middlings compartment 54. The first compartment 52 includes a doctor 60 in contact with the rotor surface 12 for physically removing the first particle component from the rotor surface. In accordance with the present invention, the divider 50 is moved closer to the rotor surface 12, part way into the boundary layer 22 of gas, without however removing the second component of the particle mix. For example, in commercially available electrostatic separation apparatus as delivered, the splitter 50 is spaced about one-eighth inch from the rotor surface 12. For use in the present invention, the splitter 50 can advantageously be moved to within 1/32" of the rotor surface.

The doctor 60 is intended only to remove the first component of the particle feed from the rotor surface 12, but unavoidably it removes also the boundary layer of gas which arrives to the doctor. This results in putting gas into the receiver compartment 52, which again can cause the finer particles to be blown around into a cloud of dust in the apparatus. Moving the splitter 50 closer to the rotor surface 12 so as to strip away a substantial portion of the boundary layer 22 helps to minimize such dust-cloud formation. FIG. 6 illustrates another measure, which can be used alone or in conjunction with the closer spacing of the splitter 56, to to control dust clouds in the apparatus.

In FIG. 6, a shroud 62, 64 is fitted to the doctor 60, for containing any gas that is stripped from the rotor surface 12 by the doctor. The shroud has a first part 62 which follows the contour of the rotor surface for a distance toward the support 26 for the barrier 28, and a second part 64 which curves away from the rotor and returns toward the radially-extended locus of the doctor. The arm 66 which holds the doctor 60 also holds a cross-arm 68 on which the shroud parts are supported.

FIGS. 7 and 8 illustrate an alternative particle feed mechanism, which can replace the hopper 16 and corona shield 32. A feed tube 70 is fitted to the mechanical barrier 28, and the particle feed is conveyed pneumatically to the rotor surface 12 in the form of a particle/gas mixture 74 through the feed tube and under the barrier. The boundary layer 22 is removed as in FIG. 1, and reforms from the gas used to convey the particle feed through the feed tube 70. The edges 72, 72 of the barrier 28 can be held against the rotor surface 12, either mechanically or electrostatically, for example, to prevent escape laterally of the particle/gas mixture. This method of feeding the particles to the receiving surface 12 has several advantages, in addition to controlling the boundary layer 22. Fine particles have a tendency to agglomerate, and the high degree of shear in gas located between the moving surface 12 and the stationary flexible sheet 28 helps to break up agglomerates of particles, so that the particles can be more readily given individual charges, and eventually separated by an electrification mechanism.

I claim:

1. In a method for the beneficiation of particulate solid substances by means of an electrification mechanism of the electrostatic separation kind wherein said substance includes a substantial proportion of dust-like particles ranging in size down to about 20 microns, and wherein said method employs the known step of depositing a feed of particulate solid substance onto a moving surface of a rotor which is surrounded by an ambient gas forming a boundary layer of gas which moves with said surface relative to ambient gas more remote from said surface, the improvement comprising the steps of isolating said moving surface by stripping said boundary layer of gas from said moving surface prior to the region where said feed is deposited, maintaining said feed region substantially free of said boundary layer while depositing said feed on said surface in said feed region after said stripping and prior to reformation of said boundary layer, and forming a mixture of said feed in a layer of gas entrained on said surface beyond said feed region in the direction of rotation of said surface.

2. In a method according to claim 1 wherein said rotor has a substantially cylindrical surface for receiving said feed, said rotor carrying entrained on said surface when said rotor is turning said boundary layer of gas between said rotor and ambient gas that is more remote from said surface, and allowing said boundary layer to reform on said surface with said particles entrained in it after leaving said feed region.

3. The method of claim 2 including the further step of spraying said reformed boundary layer and particle feed with mobile ions.

4. The method of claim 3 including the further step of shielding said feed region from corona wind arising from the presence of said mobile ions in the ambient gas.

5. The method of claim 4 including the further step of blocking paths through said feed region for said corona wind.

6. The method of claim 2 including the steps of conveying said feed to said surface pneumatically in a stream of said gas, and allowing said boundary layer to reform from the gas in said stream.

7. In apparatus for the beneficiation of particulate solid substances by means of an electrification mechanism of the electrostatic separation kind employing means for depositing a feed of said substances onto a feed region of a moving surface of a rotor which is surrounded by ambient gas and having entrained on said surface a boundary layer of said gas, said substances including a substantial portion of dust-like particles ranging in size down to 20 microns, means substantially in position against said surface and located in advance of said feed region relative to the direction of motion of said surface to strip said boundary layer from said moving surface immediately prior to said feed region, means to deplosit said feed on said feed region of said surface in the substantial absence of said boundary layer of gas that is approaching said feed region, and means to form a mixture of said feed and a gas arriving on said surface in or beyond said feed region in the direction of motion of said surface.

8. Apparatus according to claim 7 wherein said rotor has a substantially cylindrical surface for receiving said feed, said rotor carrying entrained on said surface when said rotor is turning said boundary layer of gas between said rotor and ambient gas that is more remote from said surface, means substantially in position against said surface to maintain said feed region substantially free of said boundary layer approaching said feed region.

9. Apparatus according to claim 8 including means to spray said reformed boundary layer and particles with mobile ions.

10. Apparatus according to claim 9 including corona-shield means for shielding said feed portion of said surface from corona wind arising from the presence of said mobile ions in the ambient gas.

11. Apparatus according to claim 10 including barrier means adjacent said feed portion of said surface for stopping passage of said corona wind.

12. Apparatus according to claim 8 including fluid-conduit particulate feed means to convey said feed in a stream of gas, and means to reform said boundary layer from the gas in said stream.

13. In a method for the beneficiation of particulate solid substances by means of an electrification mechanism of the electrostatic separation kind wherein said substance includes a substantial proportion of dust-like particles ranging in size down to about 20 microns, and wherein said method employs essentially the known steps of depositing a feed of a particulate solid substance onto a moving surface of a rotor having a substantially cylindrical surface for receiving said feed, said rotor carrying entrained on said surface when said rotor is turning a boundary layer of gas between said rotor and ambient gas that is more remote from said surface, the improvement comprising the steps of isolating said moving surface from gas by stripping said boundary layer from said surface prior to the region where said feed is deposited, depositing said feed on said surface in said feed region, after said stripping and prior to reformation of said boundary layer, forming a mixture of said feed in a reformed boundary layer of gas entrained on said surface beyond said feed region in the direction of motion of said surface, spraying said reformed boundary layer and particle feed with mobile ions, shielding said feed region from corona wind arising from the presence of said mobile ions in the ambient gas, and blocking paths through said feed region for said corona wind.

14. In a method for the beneficiation of particulate solid substances by means of an electrification mechanism of the electrostatic separation kind wherein said substance includes a substantial proportion of dust-like particles ranging in size down to about 20 microns, and wherein said method employs essentially the known steps of depositing a feed of a particulate solid substance onto a moving surface of a rotor having a substantially cylindrical surface for receiving said feed, said rotor carrying entrained on said surface when said rotor is turning a boundary layer of gas between said rotor and ambient gas that is more remote from said surface, the improvement comprising the steps of isolating said moving surface from gas by stripping said boundary layer from said surface prior to the region where said feed is deposited, conveying said feed to said surface pneumatically in a stream of said gas, depositing said feed on said surface in said feed region, after said stripping and prior to reformation of said boundary layer, and forming a mixture of said feed in a reformed boundary layer of gas in said stream entrained on said surface beyond said feed region in the direction of motion of said surface.

15. In apparatus for the beneficiation of particulate solid substances by means of an electrification mechanism of the electrostatic separation kind employing means for depositing a feed of said substances onto a moving surface of a rotor having a substantially cylindrical surface for receiving said feed, said rotor carrying entrained on said surface when said rotor is turning a boundary layer of gas between said rotor and ambient gas that is more remote from said surface, said substances, including a substantial proportion of dust-like particles ranging in the size down to about 20 microns, means located in advance of said feed portion of said surface relative to said direction of motion to strip said boundary layer from said surface, so as to isolate a portion of said moving surface from gas, means to deposit said feed on said portion of said surface, means to reform a barrier layer mixture of said feed and a gas on said surface beyond said portion in the direction of motion of said surface, means to spray said reform barrier layer and particles with mobile ions, corona shield means for shielding said feed portion of said surface from corona wind arising from the presence of said mobile ions in the ambient gas, and barrier means adjacent said feed portion of said surface for stopping passage of said corona wind.

16. In apparatus for the beneficiation of particulate solid substances by means of an electrification mechanism of the electrostatic separation kind employing means for depositing a feed of said substances onto a moving surface of a rotor having a substantially cylindrical surface for receiving said feed, said rotor carrying entrained on said surface when said rotor is turning a boundary layer of gas between said rotor and ambient gas that is more remote from said surface, said substances including a substantial proportion of dust-like particles ranging in size down to about 20 microns, means located in advance of said feed portion of said surface relative to said direction of motion to strip said boundary layer from said surface so as to isolate a portion of said moving surface from gas, fluid-conduit particulate feed means to convey said feed in a stream of gas, means to deposit said feed on said portion of said surface, and means to reform a boundary layer mixture of said feed and the gas in said stream on said surface beyond said portion in the direction of motion of said surface.

* * * * *